US005123862A

United States Patent [19]

Suzuki

[11] Patent Number: 5,123,862

[45] Date of Patent: Jun. 23, 1992

[54] MOUNTING CONSTRUCTION FOR CONNECTOR AND GROMMET

[75] Inventor: Tetsuaki Suzuki, Shizuoka, Japan

[73] Assignee: Yazaki Corporation, Tokyo, Japan

[21] Appl. No.: 689,568

[22] Filed: Apr. 23, 1991

[30] Foreign Application Priority Data

Apr. 24, 1990 [JP] Japan ..... 2-43036

[51] Int. Cl.[5] ..... H01R 13/60; H01R 13/621

[52] U.S. Cl. ..... 439/533; 439/559

[58] Field of Search ..... 439/34, 271, 277, 278, 439/359, 362, 533, 548, 550, 559, 563, 564, 565, 572, 573

[56] References Cited

U.S. PATENT DOCUMENTS 3,753,212 8/1973 Yamada et al. ..... 439/559 X
4,573,757 3/1986 Cochran et al. ..... 439/271
4,577,919 3/1986 Waters ..... 439/362 X
4,634,203 1/1987 Noyes ..... 439/359 X

*Primary Examiner*—Eugene F. Desmond
*Attorney, Agent, or Firm*—Sughrue, Mion, Zinn, Macpeak & Seas

[57] ABSTRACT

A female connector, normally inserted into a mounting panel, is provided with projections which correspond to receptive portions provided in a grommet which covers the connector. The receptive portions may include rigid members disposed therein to facilitate mating with the projections. Where a male connector is provided on the other side of the mounting panel, and is connected with the female connector through an insertion hole in the mounting panel, the male connector may be provided with similar projections, and a grommet for the connector may be provided with respective receptive portions.

18 Claims, 6 Drawing Sheets

MOUNTING CONSTRUCTION FOR CONNECTOR AND GROMMET

BACKGROUND OF THE INVENTION

This invention relates to a mounting construction for a connector and a grommet, by which the attachment of a grommet and the connection between connectors can be effected easily at the same time, using screws.

FIG. 9 is an exploded perspective view of a conventional mounting construction for a connector, and a grommet, and FIG. 10 is a vertical cross-sectional view of this construction in its assembled condition.

In these Figures, an insertion hole 47 is formed through a mounting panel 46 for an automobile or the like. Stud bolts 48 and weld nuts 49 are provided fixedly around the insertion hole 47. A packing 50 is provided next to the mounting panel 46, around the insertion hole 47. A female connector 51 is fixed in the insertion hole 47 from one side of the mounting panel 46, and a mounting flange 53 having bolt holes 52 is formed at the outer periphery of the female connector 51. A plurality of male terminals 55 connected respectively to electric wires 54 are received within the female connector 51. A rubber grommet 56 has a flange portion 57 held in intimate contact with the mounting flange 53. A metal fixing member 58 has a frame portion 59 engaged with the flange portion 57, and has bolt holes 60 corresponding respectively to the bolt holes 52 of the mounting flange 53.

On the other hand, a male connector 61 is connected to the female connector 51 from the other side of the mounting panel 46. A plurality of female terminals 69 are received within the male connector 61. A grommet 63 is fitted on the male connector 61, and a metal fixing member 64 fixes the grommet 63 to the mounting panel 46.

In FIGS. 9, for illustration purposes, the connectors 51 and 61 are shown as being withdrawn respectively from the grommets 56 and 63; however, in actuality the connectors 51 and 61 are received in the grommets 56 and 63, respectively, and tapes 65 are wound respectively on smaller-diameter portions 56*a* and 63*a* of the grommets 56 and 63. In this condition, the connectors 51 and 61 are attached to the mounting panel 46.

Then, the stud bolts 48 of the mounting panel 46 are passed through the bolt holes 52 of the female connector 51, respectively, then through the bolt holes 60 of the metal fixing member 59, and then are fixedly connected respectively to nuts 66 (see FIG. 10). Further, the male connectors 61 is connected to the female connector 51, and bolts 68 (see FIG. 10) are passed respectively through bolt holes 67 of the metal fixing member 64, and are fixedly connected respectively to the weld nuts 49.

In the above conventional construction, however, because of the multipole (multi-terminal) construction of the connectors 51 and 61, a large force is required to connect the male connector 61 to the female connector 51. As a result, the connecting operation cannot be done easily. Besides, at this time, since the male connector 61 is covered with the grommet 63, the grommet 63 must be turned back. Thus, the operation efficiency is very poor.

SUMMARY OF THE INVENTION

With the above problems in view, it is an object of this invention to provide a mounting construction for a connector and a grommet by which a multi-pole connector covered with a grommet can be connected easily and efficiently.

The above object has been achieved by a mounting construction for a connector and a grommet, constituted by, inter alia, a pair of connectors connected together through an insertion hole in a mounting panel. Grommets covering the connectors are provided, as are fixing members which secure the grommets to the mounting panel by screws. According to the invention, a pressure-receiving portion is formed on an outer surface of the connector, a receptive portion for the pressure-receiving portion is provided on the grommet, and a press portion for the receptive portion is provided on the fixing member.

Preferably, the pressure-receiving portion is in the form of a cylindrical projection, and the receptive portion has a receiving surface with an arcuate cross-section for the projection.

The receptive portion of the grommet is engaged with the pressure-receiving portion of the connector, and the press portion of the fixing member is engaged with the receptive portion. Then, the screw which secures the fixing member to the mounting panel applies a connecting force to the connector for urging the connector into connection with the mating connector. The connection between the connectors is effected simultaneously with the attachment of the grommet.

By using the cylindrical pressure-receiving portion and providing the arcuate cross-sectioned receiving surface for the receptive portion, a smooth pushing operation can be achieved.

DETAILED DESCRIPTION OF THE PREFERRED EMBODIMENTS

Figure 1:
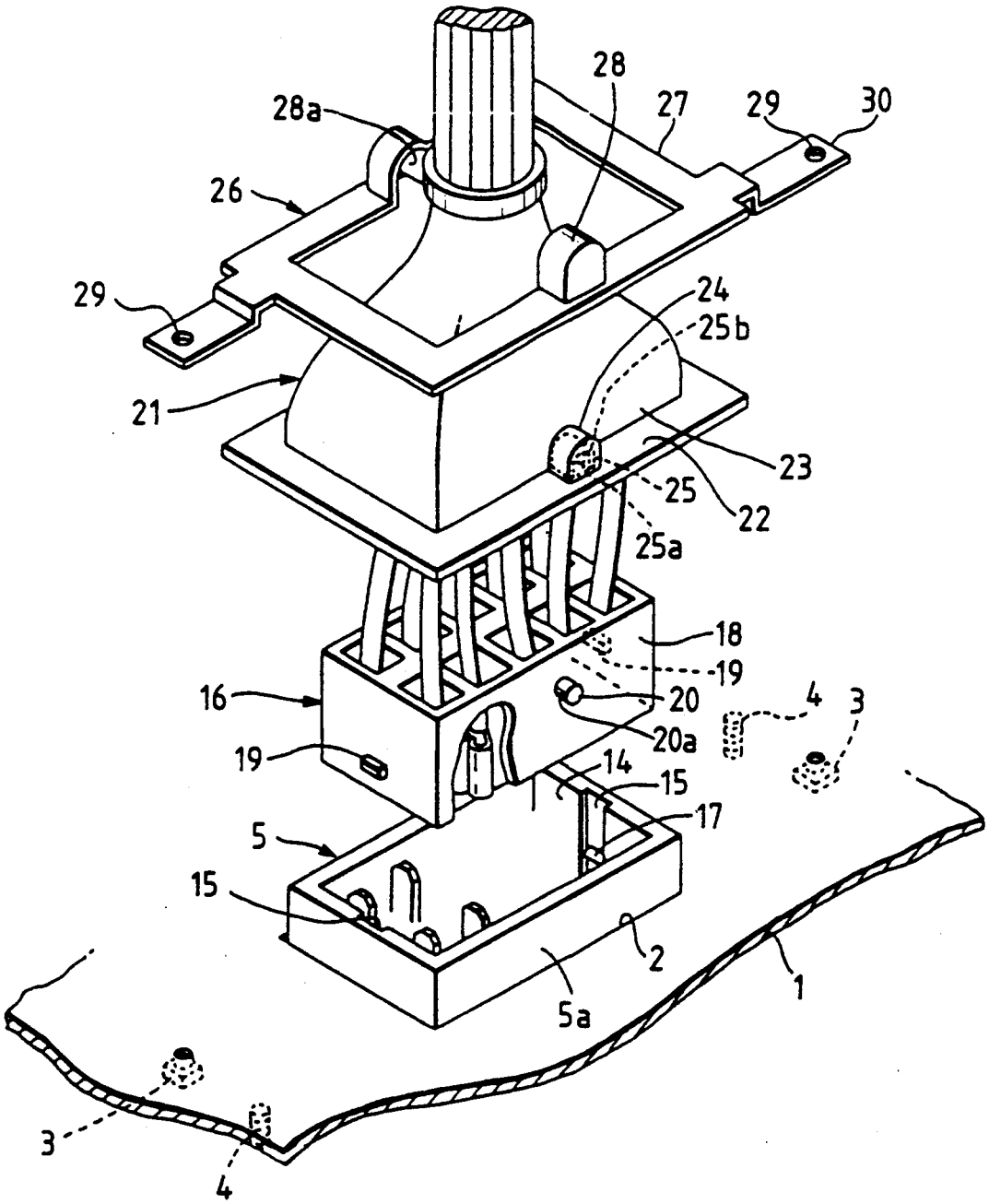
FIG. 1 is an exploded perspective view of a first embodiment of the present invention.
Figure 2:
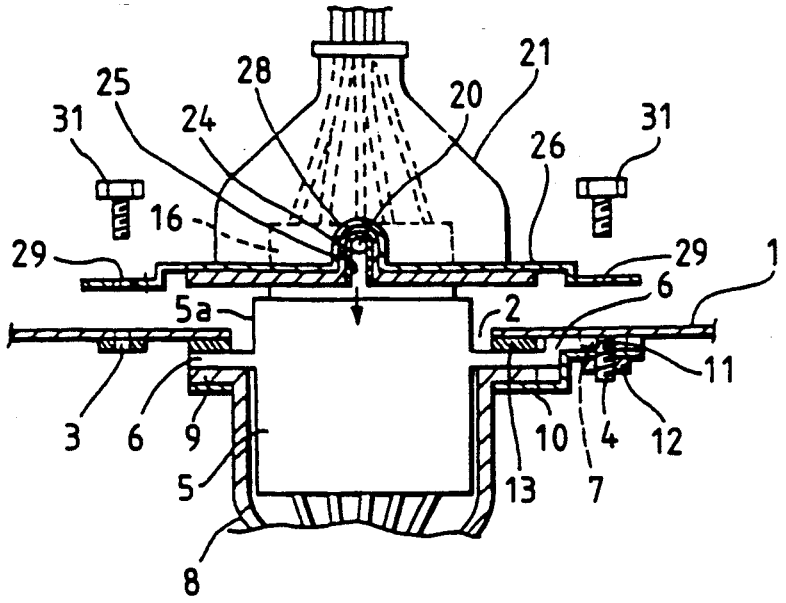
FIGS. 2 to 4 are vertical cross-sectional views of the construction of FIG. 1, showing the manner of assembly.

Referring to FIGS. 1 and 2, a conventional mounting panel 1 has weld nuts 3 as well as stud bolts 4 fixedly secured to one side thereof. The weld nuts 3 and stud bolts 4 are disposed respectively on opposite sides of a rectangular insertion hole 2. An open end portion 5*a* of a female connector 5 is inserted through the insertion hole 2, and as shown in FIG. 2, the stud bolts 4 are passed respectively through bolt holes 7 in a flange portion 6 of the female connector 5. A flange portion 9 of a rubber grommet 8 is held by a frame-shaped metal fixing member 10. The stud bolts 4 are passed respectively through bolt holes 11 in the metal fixing member 10, and the two flange portions are connected together by nuts 12. A packing 13 also is provided, as in the conventional construction.

As shown in FIG. 1, a pair of opposed vertical grooves 15 are formed in an inner surface 14 of a housing of the female connector 5. A provisionally-retaining pawl 17 for provisionally retaining a mating male connector 16 is provided at an upper portion of each vertical groove 15. Engaging projections 19 for engaging with the respective provisionally-retaining pawls 17 are formed on an outer surface 18 of a housing of the male connector 16 at a lower portion thereof. A pair of cylindrically-shaped pressure-receiving projections 20 are formed on a central portion of the outer surface 18 of the housing of the male connector 16 at an upper portion thereof.

A rubber grommet 21 has U-shaped bulge portions 24 formed thereon, the U-shaped bulge portions 24 being provided on both a flange portion 22 and a large-body portion 23 of the grommet 21. A U-shaped rigid receptive member 25, made of metal or a synthetic resin, and capable of receiving the pressure-receiving projection 20, is molded integrally in the inner surface of the bulge portion 24. A bottom surface **25*b* of a U-shaped groove 25*a* of the rigid receptive member 25 has an arcuately-curved cross-section so as to be in smooth sliding contact with a peripheral surface 20*a* of the pressure-receiving projection 20. Press portions 28, each having a U-shaped groove 28*a* for fitting on a respective one of the bulge portions 24, are formed integrally on a frame 27 of a metal fixing member 26 opposed to the flange portion 22 of the grommet 21. Fixing projections 30, each having a bolt hole 29, are formed on respective opposite ends of the metal fixing member 26**.

Figure 3:
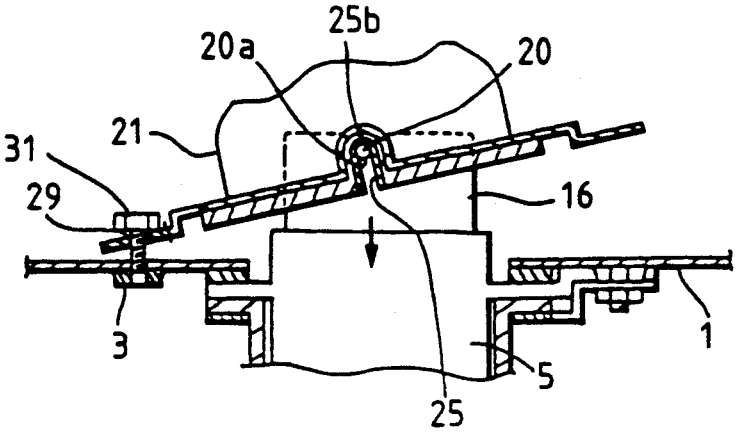
Figure 4:
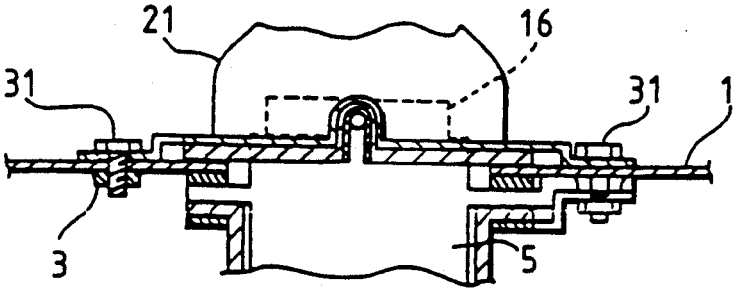

As shown in FIGS. 2 to 4, the grommet 21 is fitted on the male connector 16, and the metal fixing member 26 is attached to the grommet 21. In this condition, the metal fixing member 26 is secured fixedly to the mounting panel 1 by bolts 31. As shown in FIG. 1, the weld nuts 3 are secured fixedly to the mounting panel 1. FIG. 2 shows the provisionally-retained condition of the connectors 5 and 16, in which the engaging projections 19 (see FIG. 1) of the male connector 16 respectively slide over, and are engaged with the provisionally-retaining pawls 17 of the female connector 5.

FIG. 3 shows a condition in which one of the bolts 31 is passed through the bolt hole 29 of the metal fixing member 26 and is being threaded into the weld nut 3 on the mounting panel 1. In this condition, although the grommet 21 and the metal fixing member 26 are inclined, the groove bottom surface (arcuate receiving surface) **25*b* of each rigid receptive member 25 is disposed in sliding contact with the peripheral surface 20*a* of the pressure-receiving projection 20, and always produces a downward pressing force (i.e., in the direction of connection of the connector). Further, since the pressure-receiving projections 20 are formed at the upper central portion (at the center line) of the male connector 16, forcible scratching or the like is not encountered. Therefore, smooth connection between the connectors can be achieved. Incidentally, if the U-shaped groove 25*a* of the rigid receptive member 25 is made shorter, so that the center of the arcuate receiving surface 25*b* is aligned with the axis of the cylindrical pressure-receiving projection 20, a smoother connector connection can be achieved. FIG. 4 shows a condition in which the two bolts 31 are tightened to complete the connection between the connectors 5 and 16**.

Figure 5:
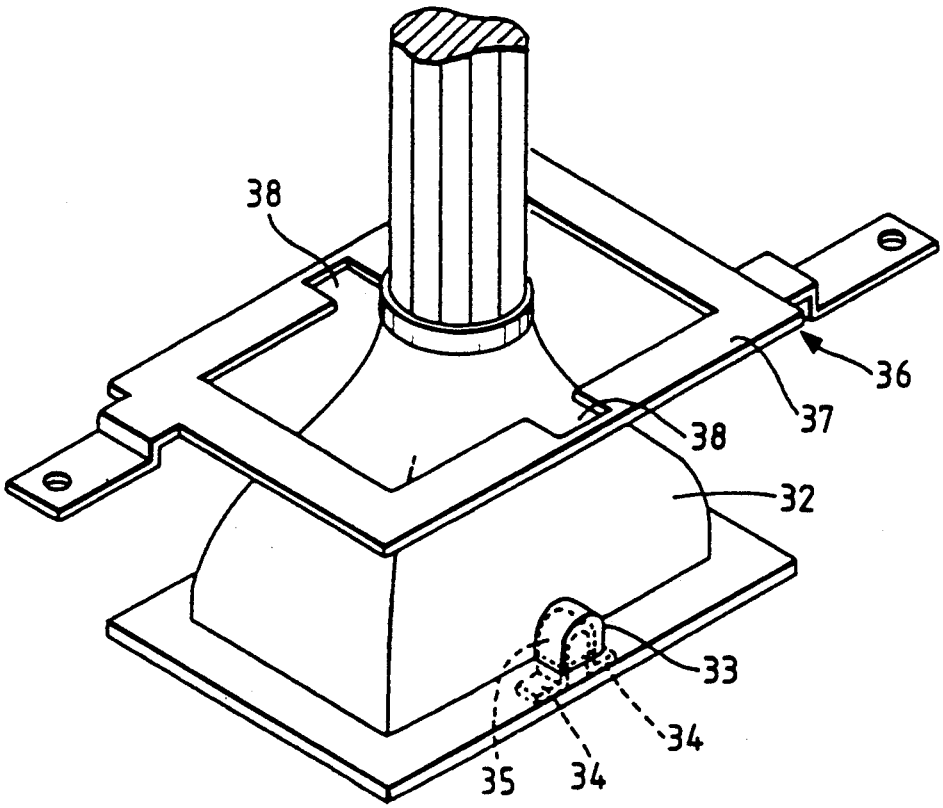
FIG. 5 is a perspective view of a first modification of the embodiment of FIG. 1.

FIG. 5 shows a first modification of the above embodiment, in which a rigid receptive member 35, having a flange 34, is molded integrally in an inner surface of a bulge portion 33 of a grommet 32. An insertion notch 38 for the bulge portion 33 is formed in a frame portion 37 of a metal fixing member 36, in place of the press portion 28 of the previous embodiment. A feature of this construction is that the frame portion 37 can press the flange 34 of the rigid receptive member 35.

Figure 6:
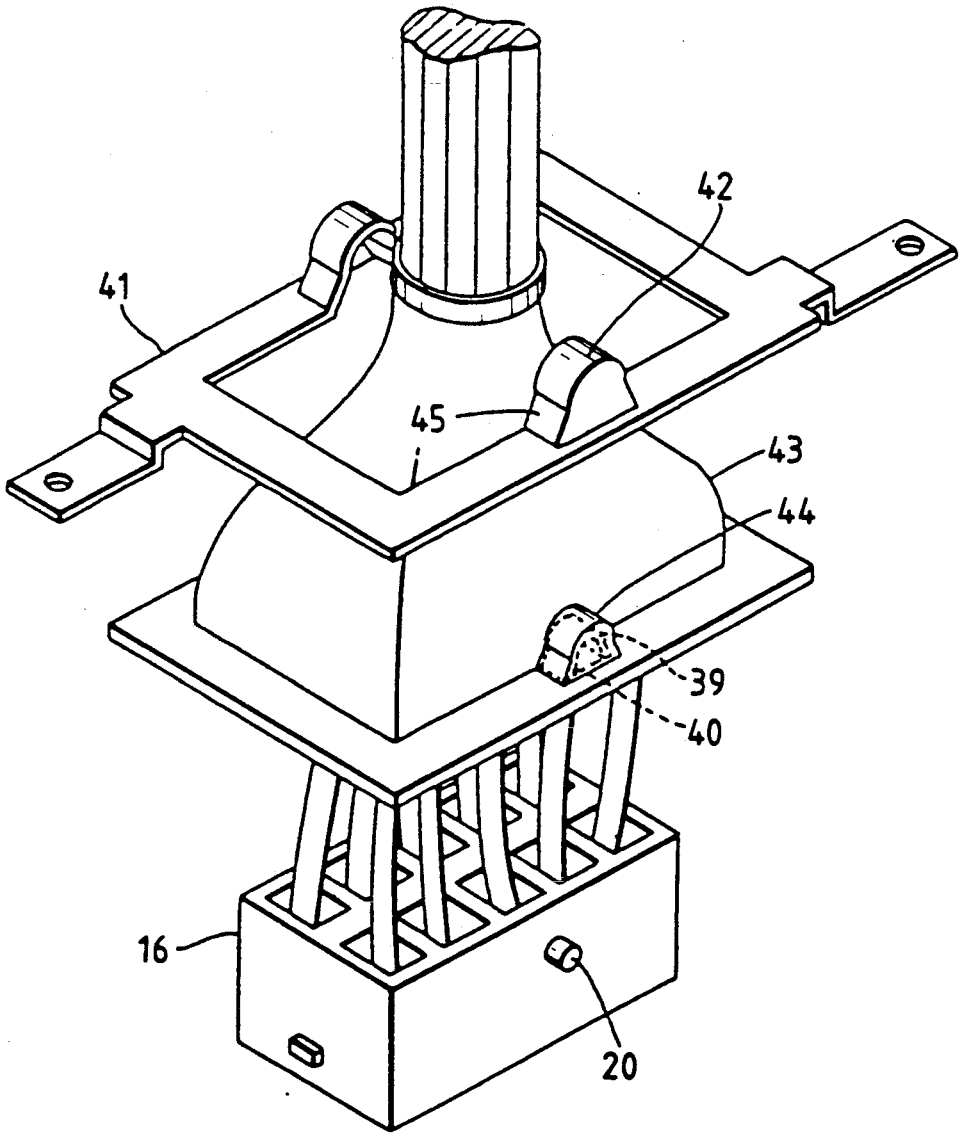
FIG. 6 is an exploded perspective view of a second modification of the embodiment of FIG. 1.

FIG. 6 shows a second modification in which a flaring guide portion 40 is formed at a skirt portion of a rigid receptive member 39. Thanks to the guide portion 40, the pressure-receiving projection 20 of the male connector 16 can be inserted into the rigid receptive portion 39 more easily. Also, a flaring skirt portion 45 matching a bulge portion 44 of a grommet 43 is formed on a press portion 42 of a metal fixing member 41.

In the first embodiment (FIGS. 1 and 2), the female connector 5 first is secured fixedly to the mounting panel 1, and the metal fixing member 26 is secured to the mounting panel 1 by the bolts 31, thereby connecting the male connector 16 to the female connector 5. However, in a similar manner as described above for the male connector 16, the pressure-receiving projections 20 may be provided on the female connector 5, the rigid receptive members 25 may be provided on the grommet 8 for the female connector 5, and the press portions 28 may be provided on the metal fixing member 6. In this case, the female connector 5 and the male connector 16 can be connected together by common screw means (not shown).

Figure 7:
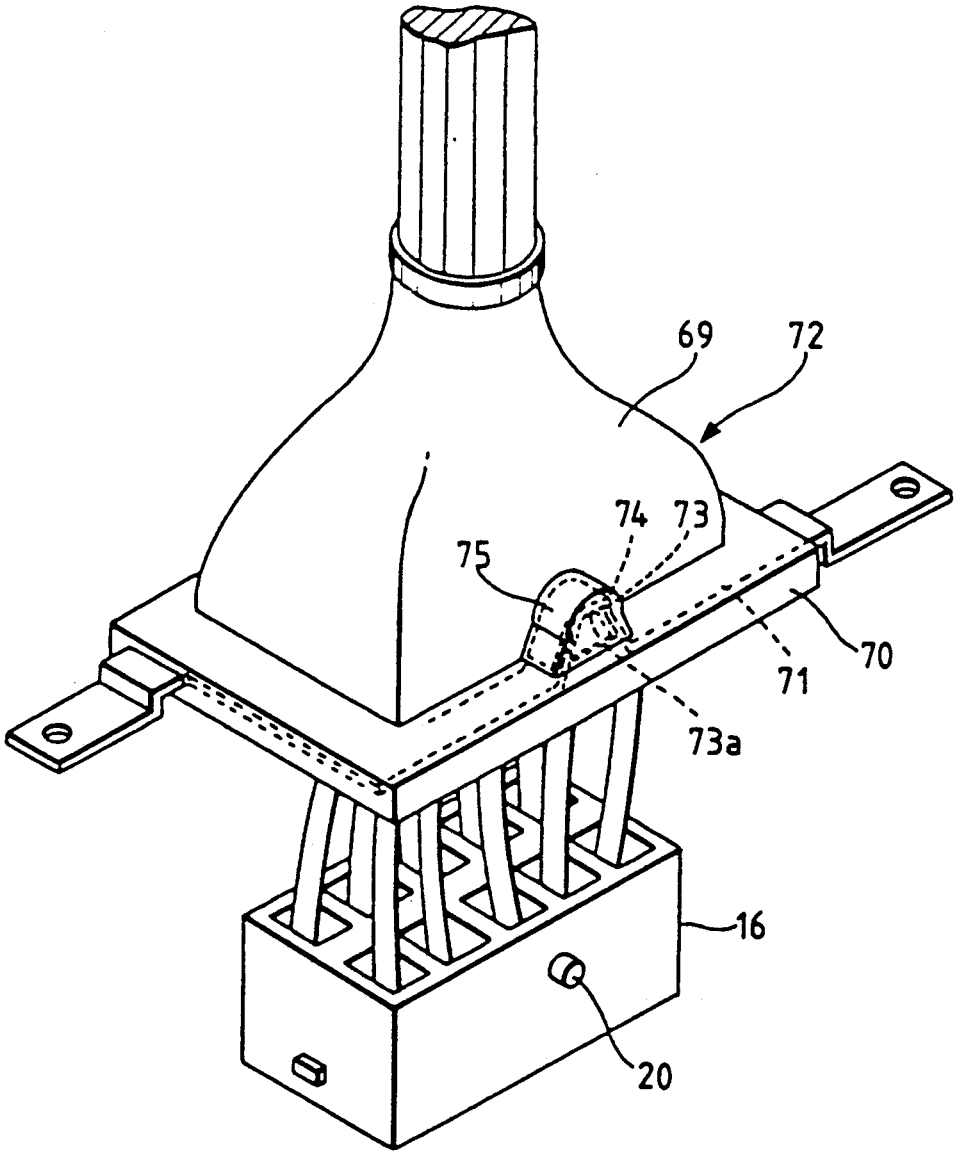
FIG. 7 is a perspective view of a second embodiment of the invention.
Figure 8:
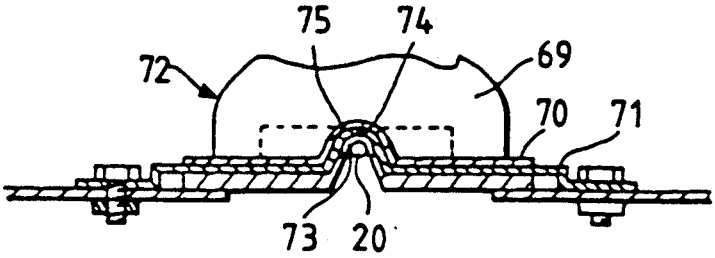
FIG. 8 is a vertical cross-sectional view of the second embodiment in its assembled condition.
Figure 9:
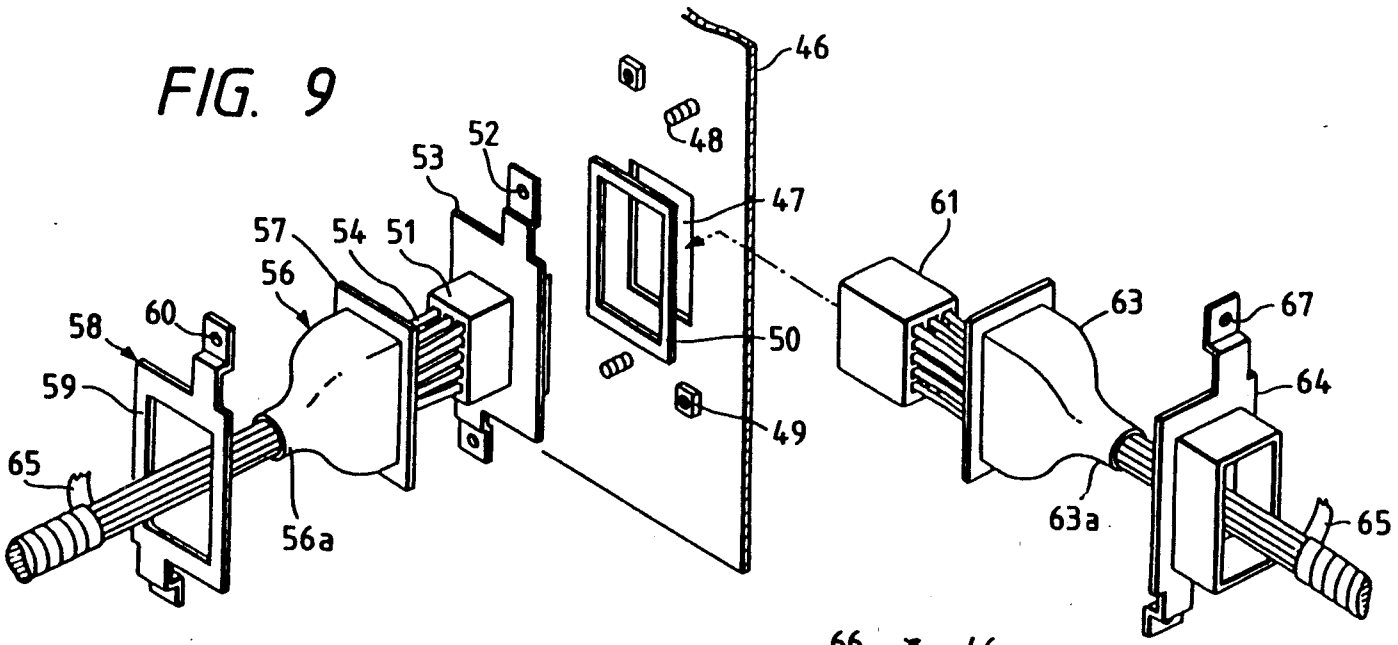
FIG. 9 is an exploded perspective view of a conventional construction.
Figure 10:
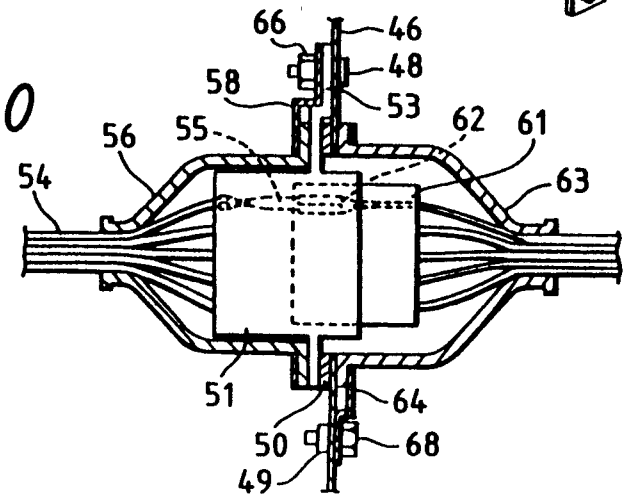
FIG. 10 is a vertical cross-sectional view of the structure of FIG. 9 in its assembled condition.

In FIGS. 7 and 8, showing a second embodiment of a connector and grommet-mounting construction according to the present invention, a frame-shaped metal fixing member 71 is molded integrally in a flange portion 70 of a rubber grommet 69 to provide a grommet molded body 72. A resilient receptive portion 73 having a cross sectionally-arcuate receiving surface 73 for a pressure-receiving projection 20 of a male connector 16, as well as a rigid press portion 74, is formed integrally within each bulge portion 75 on the flange portion 70 of the grommet molded body 72.

As described above, in the present invention, the connection of the connectors can be made simultaneously with the attachment of the grommet. Therefore, even when a large insertion force is required because of an increased number of terminals, the connection operation can be performed easily. Further, at this time, the grommet does not need to be turned back, and therefore a good operation efficiency results.

While the present invention has been described in detail with reference to preferred embodiments thereof, various modifications within the scope and spirit of the invention will be apparent to those of working skill in this technological field. Thus, the invention should be considered as limited only by the appended claims.

What is claimed is:

1. A mounting construction for securing a first connector to a second connector, comprising:

a mounting panel having an insertion hole, said second connector being mounted in said insertion hole;

a first grommet covering substantially all of said first connector;

a first fixing member circumscribing said first grommet for securing said first grommet to said mounting panel;

first screw means for securing said first grommet to said mounting panel via said first fixing member;

a first pressure-receiving portion protruding from an outer surface of said first connector; and a first receptive means provided on said first grommet, for receiving said first pressure-receiving portion in a direction of insertion of said first connector into said second connector such that said first connector is connectable to said second connector by urging said first grommet in said insertion direction.

2. A mounting construction according to claim 1, wherein said first grommet and said first fixing member are integrally molded.

3. A mounting construction according to claim 1, wherein said first pressure-receiving portion comprises a cylindrical projection, said first receptive means having a receiving surface, having an arcuate cross-section, for receiving said cylindrical projection.

4. A mounting construction according to claim 2, wherein said first pressure-receiving portion comprises a cylindrical projection, said first receptive means having a receiving surface, having an arcuate cross-section, for receiving said cylindrical projection.

5. A mounting construction according to claim 1, wherein said first receptive means comprises one of a metal or a synthetic resin.

6. A mounting construction, comprising:

a mounting panel having an insertion hole;

a first connector mounted over said insertion hole;

a first grommet covering said first connector;

a first fixing member for securing said first grommet to said mounting panel;

first screw means for securing said first grommet to said mounting panel via said first fixing member;

a first pressure-receiving portion formed on an outer surface of said first connector; and a first receptive portion, provided on said first grommet, for receiving said first pressure-receiving portion, wherein said first receptive portion includes a bulge portion, formed on said first grommet, and a rigid receptive member disposed within said bulge portion for contacting said first pressure-receiving portion.

7. A mounting construction according to claim 6, wherein said bulge portion includes a flared skirt portion at a bottom portion thereof.

8. A mounting construction, comprising:

a mounting panel having an insertion hole;

a first connector mounted over said insertion hole;

a first grommet covering said first connector;

a first fixing member for securing said first grommet to said mounting panel;

first screw means for securing said first grommet to said mounting panel via said first fixing member;

a first pressure-receiving portion formed on an outer surface of said first connector;

a first receptive portion, provided on said first grommet, for receiving said first pressure-receiving portion;

a second connector, provided on an opposite side of said mounting panel facing said first connector;

a second grommet covering said second connector;

a second fixing member for securing said second grommet to said mounting panel;

second screw means for securing said second grommet to said mounting panel via said second fixing member;

a second pressure-receiving portion, formed on an outer surface of said second connector; and a second receptive portion, provided on said second grommet, for receiving said second pressure-receiving portion.

9. A mounting construction according to claim 8, wherein each of said first and second pressure-receiving portions comprises a cylindrical projection, each of said first and second receptive portions having a respective receiving surface, having an arcuate cross-section, for receiving each said cylindrical projection, respectively.

10. A mounting construction according to claim 8, wherein each of said first and second receptive portions comprises one of a metal or a synthetic resin.

11. A mounting construction according to claim 8, wherein each of said first and second receptive portions includes a bulge portion, formed respectively on said first and second grommets, and a rigid receptive member disposed within said bulge portion for respectively contacting said first and second pressure-receiving portions.

12. A mounting construction according to claim 11, wherein each said bulge portion includes a flared skirt portion at a bottom portion thereof.

13. A mounting construction, comprising:

a mounting panel having an insertion hole;

a first connector mounted over said insertion hole;

a first grommet covering said first connector;

a first fixing member for securing said first grommet to said mounting panel;

first screw means for securing said first grommet to said mounting panel via said first fixing member;

a first pressure-receiving portion formed on an outer surface of said first connector;

a first receptive portion, provided on said first grommet, for receiving said first pressure-receiving portion; and a first press member, disposed on said fixing member, for pressing said first receptive portion.

14. A mounting construction, comprising:

a mounting panel having an insertion hole;

a first connector mounted over said insertion hole;

a first grommet covering said first connector;

a first fixing member for securing said first grommet to said mounting panel;

first screw means for securing said first grommet to said mounting panel via said first fixing member;

a first pressure-receiving portion formed on an outer surface of said first connector; and a first receptive portion, provided on said first grommet, for receiving said first pressure-receiving portion, wherein said first fixing member includes an insertion notch for accommodating said first receptive portion.

15. A mounting construction comprising:

a mounting panel having an insertion hole;

a first connector mounted over said insertion hole;

a first grommet covering said first connector;

a first fixing member for securing said first grommet to said mounting panel via said first fixing member;

first screw means for securing said first grommet to said mounting panel a first pressure-receiving portion, formed on an outer surface of said first connector;

a first receptive portion, provided on said first grommet, for receiving said first pressure-receiving portion, said first receptive portion including a first bulge portion, formed on said first grommet, and a first rigid receptive member disposed within said bulge portion for contacting said first pressure-receiving portion;

a first press portion, provided on said first fixing member, for pressing said first receptive portion;

a second connector, provided on an opposite side of said mounting panel facing said first connector;

a second grommet covering said second connector;

a second fixing member for securing said second grommet to said mounting panel;

second screw means for securing said second grommet to said mounting panel via said second fixing member;

a second pressure-receiving portion, formed on an outer surface of said second connector;

a second receptive portion, provided on said second grommet, for receiving said second pressure-receiving portion, said second receptive portion including a second bulge portion, formed on said second grommet, and a second rigid receptive member disposed within said bulge portion for contacting said second pressure-receiving portion; and a second press portion, provided on said second fixing member, for pressing said second receptive portion.

16. A mounting construction according to claim 15, wherein each of said first and second pressure-receiving portions comprises a cylindrical projection, each of said first and second receptive portions having a receiving surface, having an arcuate cross-section, for respectively receiving each said cylindrical projection.

17. A mounting construction according to claim 15, wherein each of said rigid receptive members comprises one of a metal or a synthetic resin.

18. A mounting construction according to claim 17, wherein each of said first and second bulge portions includes a flared skirt portion at a bottom portion thereof.

* * * * *